United States Patent [19]

Hayashi

[11] Patent Number: 4,553,864

[45] Date of Patent: Nov. 19, 1985

[54] MULTICOLOR CROSS-HAMMER PRINTER

[75] Inventor: Mikio Hayashi, Tokyo, Japan

[73] Assignee: Seikosha Co., Ltd., Tokyo, Japan

[21] Appl. No.: 491,051

[22] Filed: May 3, 1983

[30] Foreign Application Priority Data

May 4, 1982 [JP] Japan ..... 57-74726

[51] Int. Cl.[4] ..... B41J 3/10

[52] U.S. Cl. ..... 400/121; 101/93.04; 400/240.4

[58] Field of Search ..... 400/121, 240.4; 101/93.04

[56] References Cited

U.S. PATENT DOCUMENTS 4,426,168 1/1984 Jozuka et al. ..... 400/240.4 X

FOREIGN PATENT DOCUMENTS 167459 12/1981 Japan ..... 400/121

OTHER PUBLICATIONS

*IBM Tech. Disc. Bulletin,* by D. W. Skinner et al., vol. 21, No. 5, Oct. 1978, pp. 1828–1829, 400–240.4.

*Primary Examiner*—Paul T. Sewell

*Attorney, Agent, or Firm*—Robert E. Burns; Emmanuel J. Lobato; Bruce L. Adams

[57] ABSTRACT

A multiple cross-hammer printer has a rotatable drum driven by a motor, a plurality of ridges formed on an outer peripheral surface of the drum and extending parallel to each other axially on the drum, a print head movable parallel to and axially on the drum in front thereof, the print head having a plurality of electromagnetically actuatable print hammers extending across a selected one of the ridges in confronting relation and spaced in parallel relation from each other in a direction of movement of the print head, and an ink ribbon movable with the print head and having a portion runing obliquely across and in front of the print head, the ink ribbon having a plurality of parallel color strips extending longitudinally thereon and impregnated respectively with inks of different colors, the print hammers being disposed in confronting relation to the color strips, respectively. The print hammers are selectively actuatable to press the corresponding color strips on the ink ribbon selectively against the ridges, whereby multicolor printing can be effected on a recording medium positioned between the drum and the print head while the latter moves in one stroke.

18 Claims, 14 Drawing Figures

MULTICOLOR CROSS-HAMMER PRINTER

BACKGROUND OF THE INVENTION

The present invention relates to a multicolor printer for effecting color or multicolor printing by printing individual or suitably superimposed dots of yellow, magenta and cyan, and more particularly to a multicolor cross-hammer printer capable of printing characters or symbols in multiple colors while a print head moves in one stroke without lowering the printing speed.

Prior multicolor printers have a multicolor ribbon having differently colored strips and running in front of a print head longitudinally along the direction of travel of the print head. Any desired color strip on the multicolor ribbon can be brought into confronting relation with the print head by means of a ribbon changer device. When it is desired to print characters or symbols in different colors on a single line to be printed, therefore, the ink ribbon has to be laterally shifted by the ribbon changer device to select the colors. Mixed colors other than the colors of the ribbon strips have been attained by moving the print head in several strokes along a line to be printed. More specifically, to print a dot in red color which is a mixture of yellow and magenta, for example, a yellow dot is first printed while the magenta color is superimposed on the yellow dot by the print head in a second stroke, thus forming a red dot. A dot of green or blue color can similarly be printed by superimposing dots of yellow and cyan or dots of magenta and cyan colors. Therefore, conventional multicolor printers of the type described have suffered from the drawback of having a much lower printing speed than that of general monochromatic printers capable of printing characters and symbols in one color which is typically black.

Most of the print heads used in known multicolor printers have been of the wire print head and thermal print head types. With these print heads, the dot positions are determined uniquely by the position of the print head. Therefore, it is relatively easy for these print heads to print two or more dots in a single position.

Cross-hammer or drum printers include a rotatable drum drivable by a motor and having on an outher periphery thereof a plurality of ridges extending axially on the drum. A cross-hammer print head having a print hammer facing ridges on the drum in criss-cross relation is movable in front of the drum. A dot is printed on a sheet by pressing the print hammer against the sheet on a desired ridge on the drum. The print head is moved laterally in the direction of the lines to be printed, while the drum is rotated to successively move the ridges across the path of the print hammer, thereby changing the position, horizontally and vertically, in which the print hammer crosses the ridge. Accordingly, the position of any dot to be printed is governed by both the position of the print head and the position of the drum. Such a cross-hammer print head, with a plurality of print hammers for printing dots in superimposed fashion for multicolor printing, has the drawback that variations in the speed of rotation of the drum result in variations in the dot positions, causing color dots to be out of registry in one print position.

SUMMARY OF THE INVENTION

It is an object of the present invention to provide a multicolor printer capable of effecting multicolor printing in one stroke of a print head without shifting a multicolor-inked ribbon.

Another object of the present invention is to provide a multicolor printer which can perform multicolor printing at as high a speed as monochromatic printing is effected.

Still another object of the present invention is to provide a multicolor printer having a cross-hammer print head which is subjected to little or no adverse effects due to variations in the speed of rotation of a drum, thus improving the quality of the printed dots.

According to the present invention, there is provided a multiple cross-hammer printer having a rotatable drum drivable by a motor, a plurality of ridges disposed on an outer peripheral surface of the drum and extending parallel to each other axially of the drum, a print head movable parallel to and axially of the drum in front thereof, the print head having a plurality of electromagnetically actuatable print hammers extending across a selected one of the ridges in confronting relation and spaced in parallel relation from each other in a direction of movement of the print head, and an ink ribbon movable with the print head and having a portion thereof running obliquely across and in front of the print head, the ink ribbon having a plurality of parallel color strips extending longitudinally thereon and impregnated respectively with ink of different colors, the print hammers each being disposed in confronting relation to respective ones of the color strips. The print hammers are selectively actuatable to press the corresponding color strips on the ink ribbon selectively against the ridges, whereby multicolor printing can be effected on a recording medium positioned between the drum and the print head while the latter moves in one stroke.

The above and other objects, features and advantages of the present invention will become more apparent from the following description when taken in conjunction with the accompanying drawings in which a preferred embodiment of the present invention is shown by way of an illustrative example.

DESCRIPTION OF THE PREFERRED EMBODIMENT

Figure 4:
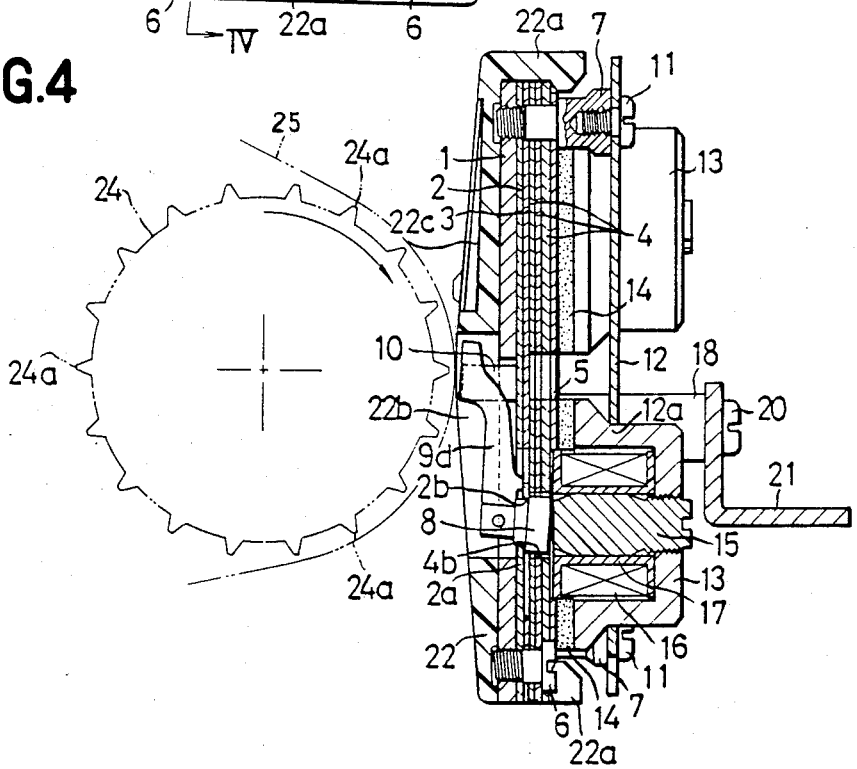
FIG. 4 is a cross-sectional view taken along line IV—IV of FIG. 3, with a rotatable drum being also illustrated.

FIG. 4 shows a multicolor cross-hammer print head according to the present invention. The print head comprises a support plate 1, a plate 2, a spacer plate 3, a plurality (three in the illustrated embodiment) of front yoke plates 4, and a coil bobbin centering plate 5, all disposed in layers and assembled together.

Figure 5:
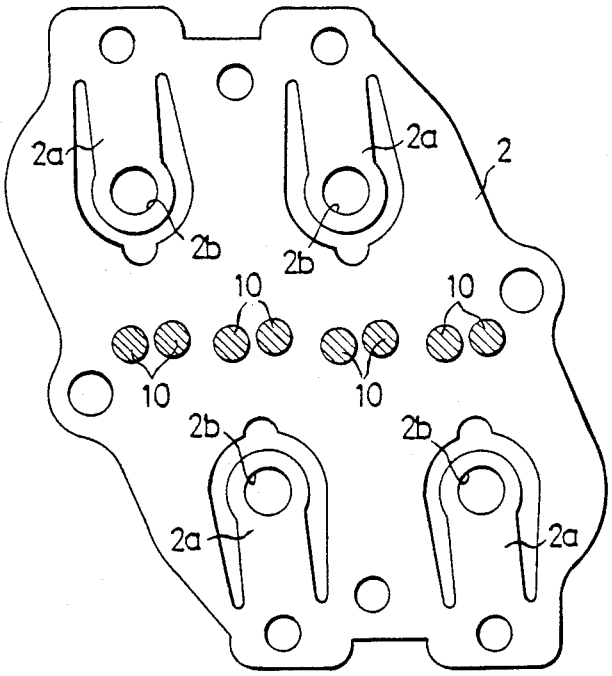
FIG. 5 is a front elevational view of a plate having spring arms formed thereon.

As illustrated in FIG. 5, the plate 2 has four integral spring arms 2*a* extending parallel to each other at an angle to the normal from the upper and lower portions of the plate 2 toward a center thereof, each spring arm 2*a* having a hole 2*b* defined in its distal end.

Figure 6:
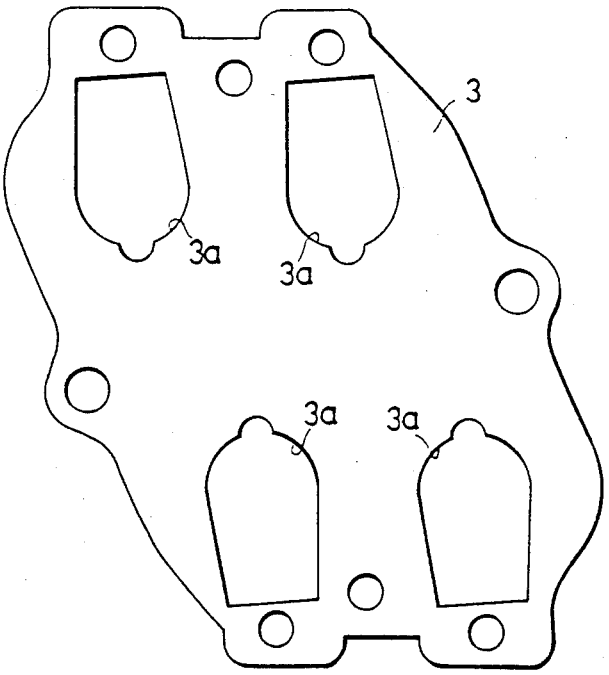
FIG. 6 is a front elevational view of a spacer plate.

The spacer plate 3, shown in FIG. 6, has four openings 3*a* positioned in registry with the spring arms 2*a*, respectively, of the plate 2.

Figure 7:
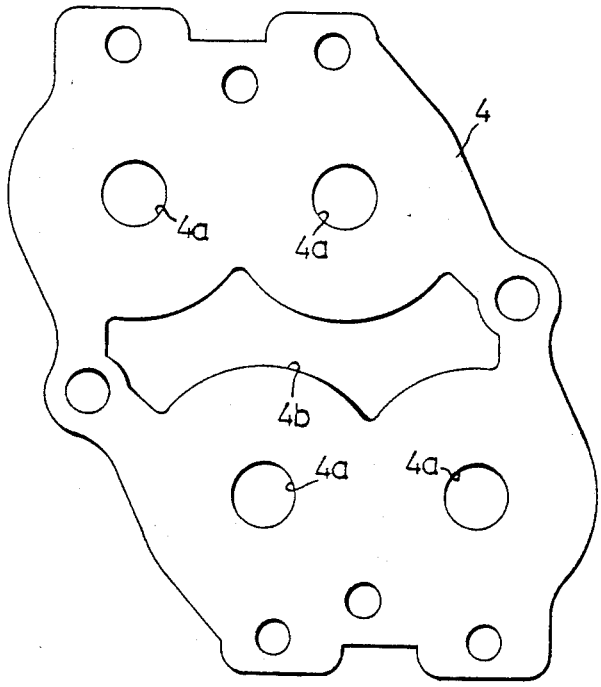
FIG. 7 is a front elevational view of a front yoke plate.

As shown in FIG. 7, each of the front yoke plates 4 has four circular apertures 4*a* and a central opening 4*b*. The apertures 4*a* have centers held in substantial alignment with those of the holes 2*b* in the spring arms 2*a* (FIG. 5), respectively.

Figure 2:
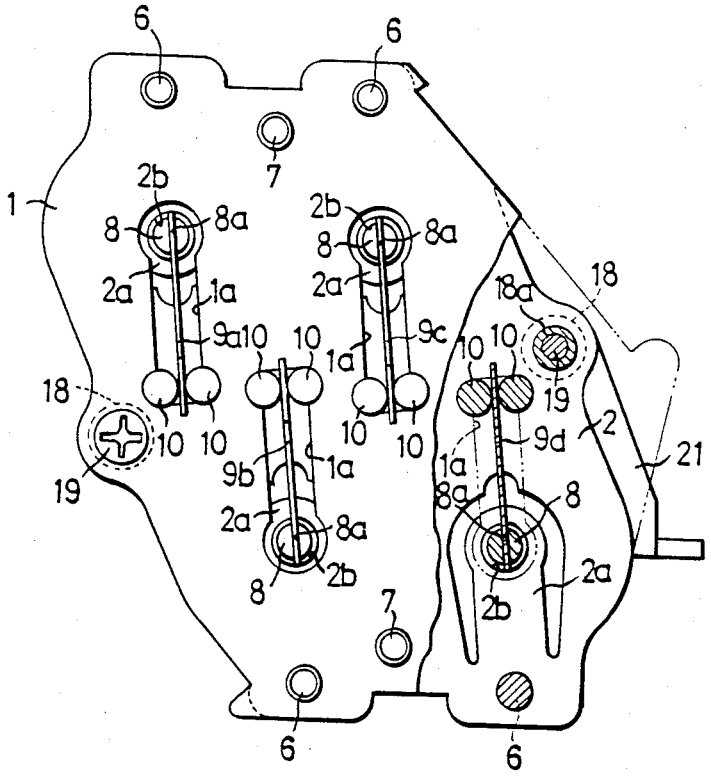
FIG. 2 is a fragmentary front elevational view of the print head shown in FIG. 1 with a ribbon guide removed.
Figure 3:
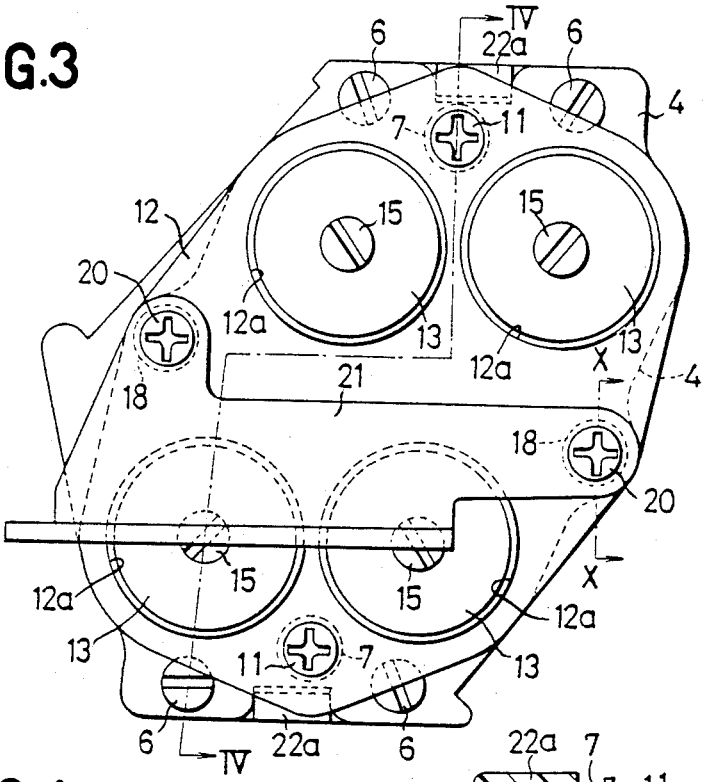
FIG. 3 is a rear elevational view of the print head of FIG. 1.
Figure 8:
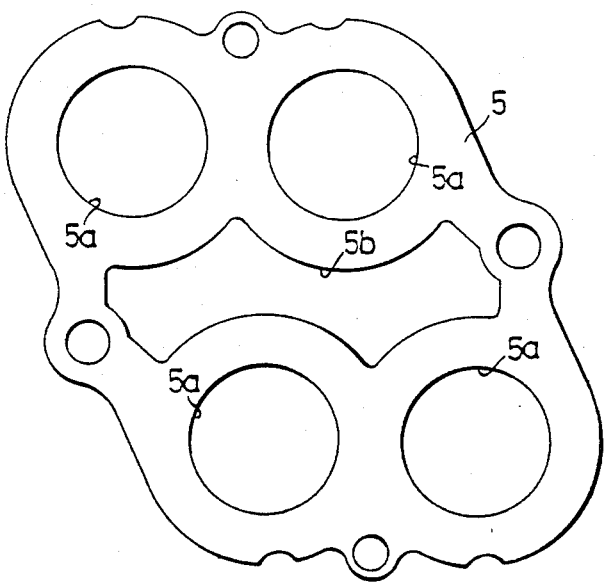
FIG. 8 is a front elevational view of a centering plate.

As illustrated in FIG. 8, the centering plate 5 also has four positioning holes 5*a* and a central opening 5*b*. The positioning holes 5*a* have centers substantially aligned with the centers of the apertures 4*a* in the front yoke plate 4 (FIG. 7), respectively. The plate 2, the spacer plate 3, the front yoke plates 4, and the centering plate 5 are fastened to the support plate 1 by screws 6 and posts 18 threaded in the support plate 1. As shown in FIGS. 2 and 3, four screws 6 and two posts 18 are provided.

In FIG. 4, movable yokes 8 are mounted respectively in the holes 2*b* in the spring arms 2*a* and have rear portions positioned in the apertures 4*a*, respectively, in the front yoke plates 4. As shown in FIG. 2, the movable yokes 8 have front slots 8*a* in which print hammers 9*a*, 9*b*, 9*c*, 9*d* are mounted, respectively. The print hammers 9*a*, 9*b*, 9*c*, 9*d* are positioned parallel to each other at an angle to the vertical axis of the print head. Each of the print hammers 9*a*, 9*b*, 9*c*, 9*d* has a respective distal end thereof guided by a pair of respective guide pins 10, 10 that serve to prevent the print hammers from wobbling laterally. The guide pins 10 project from the front surface of the plate 2. The print hammers 9*a*, 9*b*, 9*c*, 9*d* and the guide pins 10 project forward respectively through windows 1*a* defined in the support plate 1.

Figure 9:
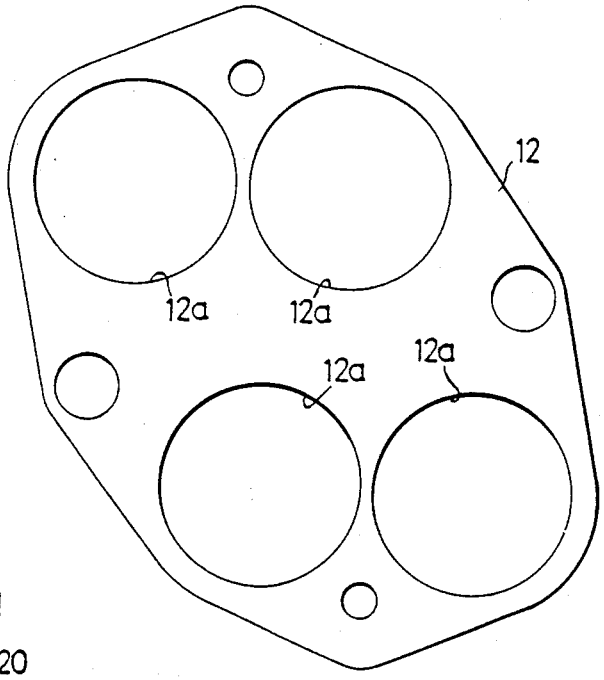
FIG. 9 is a front elevational view of a rear yoke holder plate.

As shown in FIGS. 3 and 4, a rear yoke holder plate 12 is secured by screws 11 to posts 7. The rear yoke holder plate 12 has four holder holes 12*a*, as shown in FIG. 9, having centers aligned, respectively, with the positioning holes 5*a* in the centering plate 5. Rear yokes 13 are positioned respectively in the holder holes 12*a*, as shown in FIG. 4. Doughnut-shaped or annular permanent magnets 14 are sandwiched between the rear yokes 13 and the centering plate 5. A center yoke 15 is threaded in the center of each rear yoke 13 for axial positional adjustment, the center yoke 15 extending forward into confronting relation with one of the movable yokes 8. A bobbin 17 having a coil 16 wound thereon is disposed in a space in the rear yoke 13 with the center yoke 15 extending through a central hole in the bobbin 17. The center yoke 15 thus threaded in the rear yoke 13 for positional adjustment tends to jiggle due to backlashes in the threaded parts, and fails to provide the required degree of perpendicularity with respect to the rear yoke 13. Such a problem is solved according to the present invention.

Figure 10:
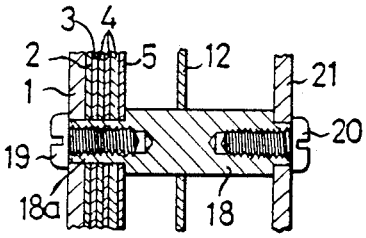
FIG. 10 is a cross-sectional view taken along line X—X of FIG. 3.

More specifically, each bobbin 17 has a front flange with its outer peripheral edge held in intimate contact with an inner peripheral edge of one of the positioning holes 5*a* in the centering plate 5. Thus, the bobbin 17 is fixed in position with respect to the centering plate 5. The center yoke 15 is inserted with a close fit through the central hole in the bobbin 17, and hence extends perpendicularly from the bottom of the rear yoke 13 along its central axis. The permanent magnet 14 has an inner peripheral surface joined to the outer peripheral edge of the front frange of the bobbin 17, so that the permanent magnet 14 is positioned coaxially with the bobbin 17. The two posts 18 shown in FIG. 3 extend through the holder plate 12 as shown in FIG. 10. Each of the posts 18 has a front smaller-diameter portion 18*a* extending through the centering plate 5, the front yoke plates 4, the spacer plate 3, the plate 2, and the support plate 1 and is secured to them by a screw 19 threaded into the front smaller-diameter portion 18*a* from the front surface of the support plate 1. The rear end of the post 18 is affixed by a screw 20 to a head support bracket 21 which is fixedly mounted on a carriage (not shown) which reciprocates the print head in forward and backward strokes.

Figure 1:
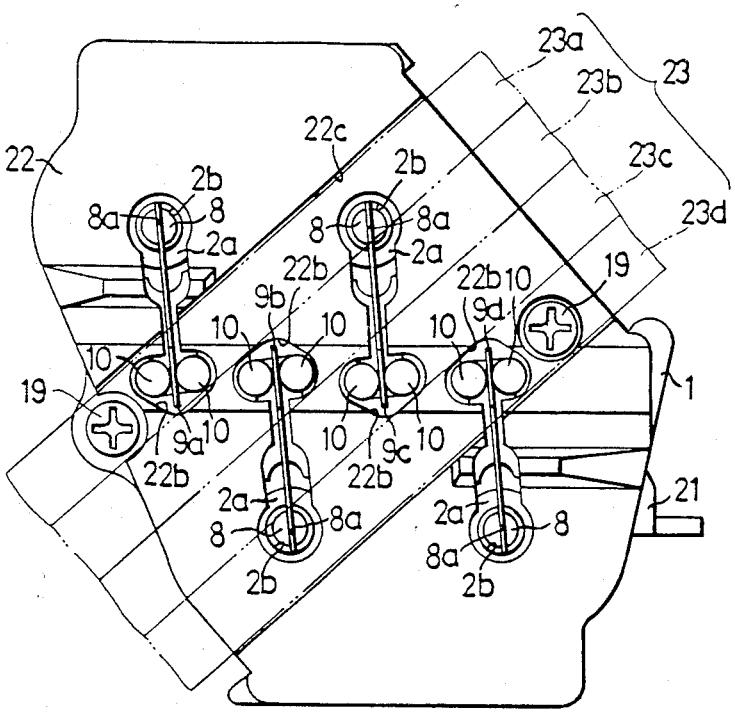
FIG. 1 is a front elevational view of a cross-hammer multicolor print head.

As illustrated in FIGS. 1 and 4, a ribbon guide 22 is removably attached to the front surface of the support plate 1 by resilient legs 22*a* of the ribbon guide 22. The ribbon guide 22 has windows 22*b* in which the print hammers 9*a*, 9*b*, 9*c*, 9*d* and the guide pins 10 are located, and a passage groove 22*c* extending obliquely across a central portion of the ribbon guide 22. An ink ribbon 23 is guided in and along the ink ribbon passage groove 22*c* to run obliquely across the print hammers 9*a*, 9*b*, 9*c*, 9*d*. The ink ribbon 23 is fed from a ribbon cassette (now shown) of any known construction. The ribbon cassette is installed on the print head in surrounding relation thereto for movement therewith. The ink ribbon 23 has four color strips 23*a*, 23*b*, 23*c*, 23*d* impregnated with inks of different colors and running parallel to each other longitudinally on the ink ribbon 23. The print hammers 9*a*, 9*b*, 9*c*, 9*d* are positionally aligned respectively with the color strips 23*a*, 23*b*, 23*c*, 23*d*. In the illustrated embodiment, the inks impregnated in the color strips have the colors of the subtractive primaries yellow, magenta and cyan, and black. However, the colors of the impregnated inks are not limited to the above, but may be any other colors.

As shown in FIG. 4, a rotatable drum 24 is positioned in front of the print head of the foregoing structure. The rotatable drum 24 has a plurality of integral parallel ridges 24*a* (eighteen in the illustrated embodiment) formed longitudinally on the drum 24 along the entire length thereof. A recording medium 25 passes between the rotatable drum 24 and the print head with the ink ribbon 23 extending in front thereof. The rotatable drum 24 has an axial length covering the width of the recording medium 25.

Figure 11:
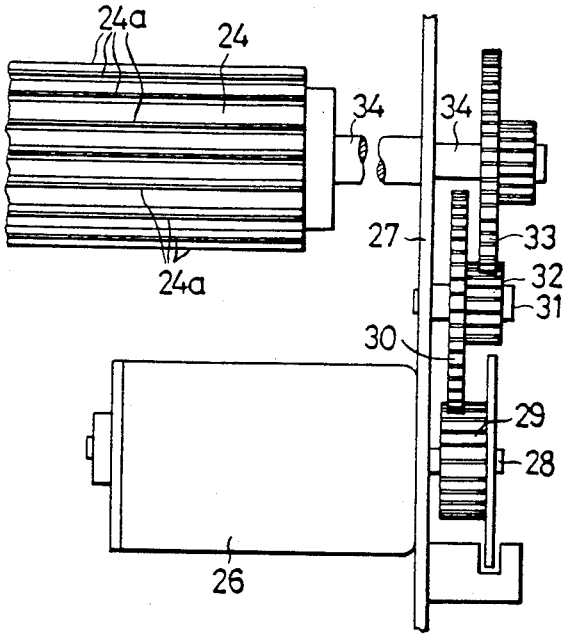
FIG. 11 is a front elevational view, on a reduced scale, of a mechanism for driving the rotatable drum.

The drum 24 is rotationally driven by a motor 26 (FIG. 11) to rotate clockwise as shown in FIG. 4 through successive angular intervals. The motor 26 is mounted on a side plate 27 and has an output shaft 28 to which is secured a pinion 29 held in driving mesh with a gear 30. The gear 30 is rotatably mounted on a shaft 31 projecting from the side plate 27. A pinion 32 is integrally formed with the gear 30 and held in driving mesh with a gear 33 secured to one end of a central shaft 34 of the rotatable drum 24.

In operation, the print head is moved at a constant speed predetermined in relation to the speed of rotation of the drum 24 in a direction transverse of the recording medium 25 for horizontal character spacing. In response to this horizontal character spacing, the print hammers 9a, 9b, 9c, 9d are shifted vertically in the direction of lines to different positions in which they cross the ridges 24a on the drum 24. At the same time, the drum 24 is rotated to move the ridges 24a vertically in the direction of columns in the position in which the ridges 24a face the print hammers 9a, 9b, 9c, 9d. Accordingly, the print hammers 9a, 9b, 9c, 9d and the ridges 24a are moved horizontally and vertically, respectively, to different positions in which they confront each other. During this character and line spacing, one of the print hammers 9a, 9b, 9c, 9d is selected, and drive pulses are selectively applied to the coil 16 (FIG. 4) associated with the selected print hammer. By way of example, a magnetic flux from the permanent magnet 14 goes through the front yoke plate 4, the centering plate 5 and the rear yoke 13 to the center yoke 15 for normally magnetically attracting the movable yoke 8 to the center yoke 15 against the resiliency of the spring arm 2a. When a drive pulse is impressed on the coil 16, the magnetic force from the permanent magnet 14 is cancelled out by a magnetic flux produced by the coil 16 to thereby enable the spring arm 2a to rapidly move forward the print hammer 9d, for example. The print hammer 9d is forced under the resiliency of the spring arm 2a to press the ink ribbon 23 and the recording medium 25 against one of the ridges 24a which confronts the print hammer 9d, whereupon a dot is printed on the recording medium 25.

Figure 12:
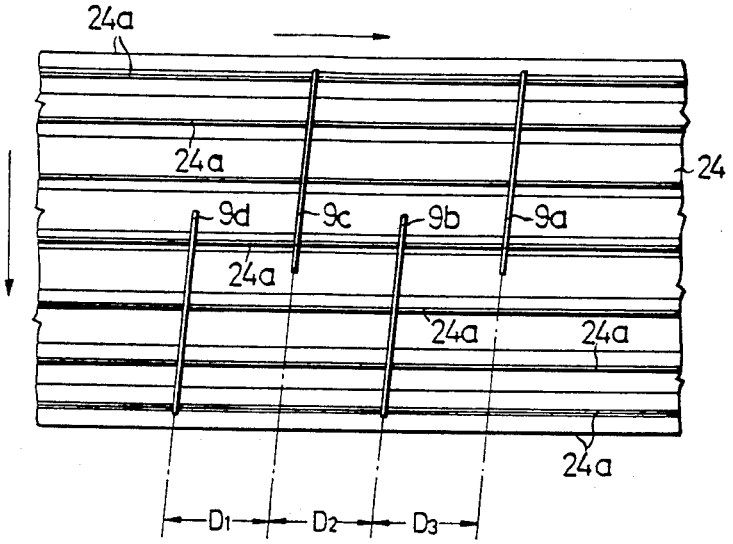
FIG. 12 is a fragmentary front elevational view of the rotatable drum and print hammers confronting the rotatable drum.
Figure 13:
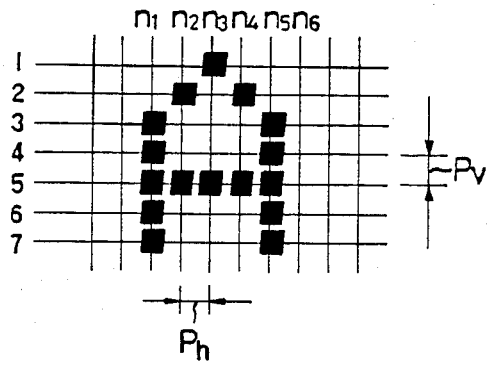
FIG. 13 is an enlarged view of a letter printed of a matrix of dots.

FIG. 13 shows a letter "A" composed of a matrix of dots printed by the printer of the invention. More specifically, dots on the $n_1$th column are selectively formed while one of the ridges 24a moves past the print hammer 9d in front thereof as shown in FIG. 4. Dots on the $n_2$th column are selectively printed while a next ridge 24a moves past the print hammer 9d in front thereof. Since the print hammer 9d faces the black ink strip 23d as shown in FIG. 1, the print hammer 9d prints dots in black. Likewise, the print hammers 9a, 9b, 9c print characters of dots in yellow, magenta and cyan, respectively. As a further example, a dot of red color can be formed by first printing a dot of yellow color with the foremost print hammer 9a as shown in FIG. 12 and then printing a dot of magenta color with the print hammer 9b on the previously printed yellow dot. Similarly, a dot of green color can be formed by first printing a dot of yellow color with the print hammer 9a and then printing a dot of cyan color with the print hammer 9c on the previously printed yellow dot. A dot of blue can be formed by first printing a dot of magenta color with the print hammer 9b and then printing a dot of cyan color with the print hammer 9c on the previously printed magenta dot. A black dot can be printed by either actuating the print hammer 9d or superimposing dots of yellow, magenta, and cyan colors with the print hammers 9a, 9b, 9c.

To superimpose dots on a single column, it would be ordinary practice to place the print hammers 9a, 9b, 9c, 9d at intervals that are a multiple, by an integer, of a lateral pitch h between the dot-matrix characters to be printed. The cross-hammer print head suffers from the problem of dot position misalignment due to variations in the speed of rotation of the drum 24 since the dot positions are determined by the positions in which the print hammers 9a, 9b, 9c, 9d cross the ridges 24a. This difficulty would still remain unsolved even with the print hammers 9a, 9b, 9c, 9d placed in the ordinary arrangement as described above. Variations in the speed of rotation of the drum 24 are caused by complex interaction between the eccentricities of the output shaft 28 of the motor 26, the gears 29, 30 and the drum 24, inertial characteristics of the drum 24, varying manufacturing errors of the ridges 24a and the gears 29, 30, and backlashes of the gears 29, 30. Of these factors, the eccentricities of the output shaft 28 of the motor 26 and the drum 24 are the most detrimental to uniform rotation of the drum 24.

Figure 14:
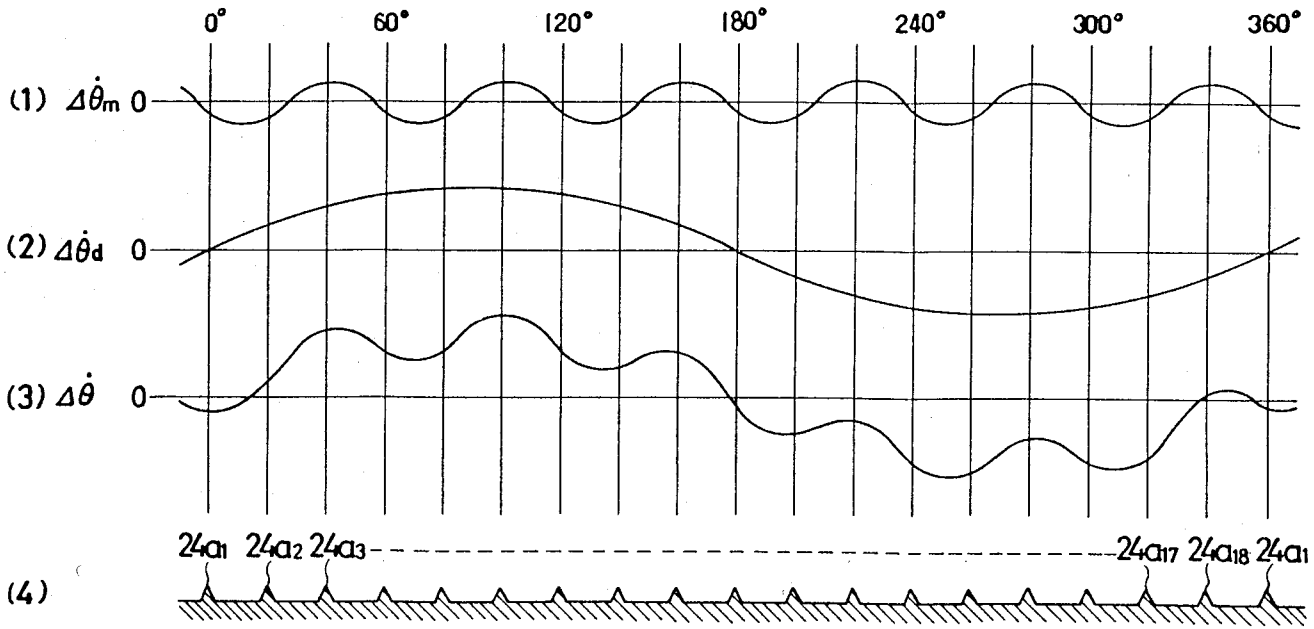
FIG. 14 is a diagram illustrative of variations in the speed of rotation of the rotatable drum, caused by a drive motor and the eccentricity of the drum, plotted in phase relation to ridges on the drum.

FIG. 14 schematically shows at (1) variations $\Delta\dot{\theta}$ m in the speed of rotation of the drum 24 caused by the eccentricity of the output shaft 28 of the motor 26, at (2) variations $\Delta\dot{\theta}$ d in the speed of rotation of the drum 24 due to the eccentricity of the drum 24 itself, and at (3) variations $\Delta\dot{\theta}$ in the speed of rotation of the drum 24 which are a combination of the variations $\Delta\dot{\theta}$ m and $\Delta\dot{\theta}$ d. FIG. 14 also illustrates at (4) the ridges 24a on the drum 24 as shown along a straight line in phase relation to the above variations, the ridges 24a being successively numbered. Where the speed reduction ratio between the motor 26 and the drum 24 is 1/k, the variations $\Delta\dot{\theta}$ m in the speed of rotation of the drum due to the motor 26 are developed k times periodically while the drum 24 mades one revolution. With k being set as a divisor (18, 9, 6, 8, 2, 1 in the illustrated embodiment) of the number N of the ridges 24a, every N/k ridges 24a have the same characteristics of rotational speed variation as shown in FIG. 14 at (1). In this embodiment, k=6 and N/k=3, and hence every three ridges 24a have the same characteristics of rotational speed variation. More specifically, ridges $24a_1$, $24a_4$, $24a_7$, $24a_{10}$, $24a_{13}$, $24a_{16}$ have the same characteristics of rotational speed variation, ridges $24a_2$, $24a_5$, $24a_8$, $24a_{11}$, $24a_{14}$, $24a_{17}$ have the same characteristics of rotational speed variation, and ridges $24a_3$, $24a_6$, $24a_9$, $24a_{12}$, $24a_{15}$, $24a_{18}$ have the same characteristics of rotational speed variation. In order to prevent the print hammers 9a, 9b, 9c, 9d from printing dots out of registry with each other, those ridges 24a which have the same characteristics of rotational speed variation should be brought into confronting relation to the print hammers 9a, 9b, 9c, 9d when dots are to be printed in one position. To effect this, the print hammers 9a, 9b, 9c, 9d should be spaced by distances $D_1$, $D_2$, $D_3$, as shown in FIG. 12, each equal to a multiple of $P_h \times (N/k)$. The printer according to the illustrated embodiment is capable of printing twelve characters of 5×7 dots in an interval of 1 inch with adjacent characters being spaced by a distance equal to one dot column. Therefore, the horizontal dot pitch $P_h$ is designed to be $25.4/(12\times 6)=0.353$ mm, and the vertical dot pitch $P_v$ is designed to be equal to the horizontal dot pitch. Therefore, the intervals $D_1$, $D_2$, $D_3$are either one of 1.06 mm, 2.12 mm, 3.17 mm, . . . , 6.35 mm, . . . In the illustrated embodiment, each of the intervals $D_1$, $D_2$, $D_3$ is designed to be 6.35 mm. This arrangement can eliminate or reduce any positional misalignment of printed dots due to variations in the speed of rotation of the motor 26.

Variations $\Delta\dot{\theta}$ d in the speed of rotation of the drum 24 due to the eccentricity of the drum 24 per se are caused once while the drum 24 makes one revolution as shown in FIG. 14 as (2). Therefore, any ridge 24*a* has the same characteristics of rotational speed variation each time it rotates N times or (N×an integer) times. In order to prevent the print hammers 9*a*, 9*b*, 9*c*, 9*d* from printing dots out of registry, those ridges 24*a* which have the same characteristics of rotational speed variation should be brought into confronting relation to the print hammers 9*a*, 9*b*, 9*c*, 9*d* when dots are to be printed in one position, as described above. Accordingly, the distances $D_1$, $D_2$, $D_3$ between the print hammers 9*a*, 9*b*, 9*c*, 9*d* should be selected to be a multiple of $P_h \times N$. Each of the distances $D_1$, $D_2$, $D_3$ is either one of 6.35 mm, 12.70 mm, 19.05 mm, . . . With the distances between the print hammers being thus selected, printed dots suffer from no or little positional misalignment due to variations in the speed of rotation of the drum 24.

Actual variations in the speed of rotation of the drum 24 are a combination of the variation $\Delta\dot{\theta}$ m and $\Delta\dot{\theta}$ d as shown in FIG. 14 at (3). By selecting a divisor of N as k and also selecting a multiple of $P_h \times N$ as the distance D between adjacent print hammers, any adverse effects due to a combination of the variation $\Delta\dot{\theta}$ m and $\Delta\dot{\theta}$ d in the speed of rotation of the drum 24 can be eliminated or reduced at the same time. By such an arrangement, variations in the speed of rotation of the drum are effectively compensated for so as to avoid non-registry of the successively printed superimposed dot matrix characters.

With the arrangement of the present invention, there is no need for a device for shifting a multicolor ink ribbon to change ink strips thereon. Desired multicolor printing can be carried out while the print head moves in one stroke, at a high speed which is substantially the same as the speed of monochromatic printing. Positional misalignment of printed dots can be avoided or reduced in multicolor or color graphic printing with a plurality of print hammers on a cross-hammer print head. Consequently, good printing quality with no out-of-registry color printing can be achieved during multicolor or color printing operation. Such elimination or reduction of any dot misalignment can be accomplished while allowing a relatively poor degree of precision with which the drum is rotated. This permits print heads to be designed and manufactured with ease.

Although a certain preferred embodiment has been shown and described, it should be understood that many changes and modifications may be made therein without departing from the scope of the appended claims. For example, the print hammers 9*a*, 9*b*, 9*c*, 9*d* can be actuated by many other mechanisms than the illustrated electomagnetic driver arrangements. Furtheremore, the distances $D_1$, $D_2$, $D_3$ may not be equalized with each other as long as they meet the requirements described above.

What is claimed is:

1. A multicolor cross-hammer printer comprising: a rotatable drum connected to be rotationally driven by a motor, the drum having a plurality of ridges disposed on an outer peripheral surface thereof, the ridges extending parallel to each other axially on said drum; a print head movable parallel to and axially of said drum in front thereof, said print head having a plurality of actuatable print hammers disposed to extend across selected ones of said ridges in confronting relation thereto during rotation of the drum and being spaced in parallel relation from each other in a direction of movement of said print head; an ink ribbon movable with said print head and having a portion running obliquely across said print head in front thereof, said ink ribbon having a plurality of parallel color strips extending longitudinally thereon and being impregnated respectively with inks of different color, said print hammers being disposed in confronting relation to said color strips, respectively; and actuating means for selectively actuating said print hammers to press the corresponding color strips on said ink ribbon selectively against the drum ridges to effect multicolor printing of dot matrix characters on a recording medium positioned between said drum and said print head while the latter moves in one stroke; adjacent print hammers being spaced from each other by a distance of $P_h \times (N/k)$, or a multiple thereof, wherein $P_h$ is a horizontal pitch of a dot matrix of characters to be printed, N is the number of said drum ridges and 1/k is the speed reduction ratio between said motor and said drum.

2. A multicolor cross-hammer printer as claimed in claim 1, in which said k is a divisor and the number N.

3. A multicolor cross-hammer printer as claimed in claim 2, in which said print hammers are spaced from each other by equal distances.

4. A multicolor cross-hammer printer as claimed in claim 3, in which said ink ribbon has four color strips impregnated with inks having colors of black and subtractive primaries yellow, magenta, and cyan.

5. A multicolor cross-hammer printer as claimed in claim 4, in which said actuating means comprises electromagnetic actuating means.

6. A multicolor cross-hammer printer as claimed in claim 2, in which said ink ribbon has four color strips impregnated with inks having colors of black and substractive primaries yellow, magenta, and cyan.

7. A multicolor cross-hammer printer as claimed in claim 2, in which said actuating means comprises electromagnetic actuating means.

8. A multicolor cross-hammer printer as claimed in claim 1, in which said print hammers are spaced from each other by equal distances.

9. A multicolor cross-hammer printer as claimed in claim 1, in which said ink ribbon has four color strips impregnated with inks having colors of black and subtractive primaries yellow, magenta, and cyan.

10. A multicolor cross-hammer printer as claimed in claim 1, in which said actuating means comprises electromagnetic actuating means.

11. A multicolor cross-hammer printer for printing dot matrix characters on a recording medium comprising: a rotationally driven drum having about its periphery a plurality of angularly spaced and axially extending parallel ridges; a rotary motor having a rotationally driven output shaft; speedreducing means interconnected between the motor output shaft and the drum for providing a speed reduction ratio of 1/k between the motor output shaft and the drum; a print head mounted to undergo reciprocable movement in forward and backward strokes parallel to and axially of the drum in confronting relation thereto, the print head comprising a plurality of actuable print hammers disposed to extend across the path of the drum ridges in confronting relation thereto during rotation of the drum and disposed in spaced-apart parallel relation from one another in a direction of movement of the print head; a multicolor ink ribbon having a plurality of lengthwise extending color strips impregnated respectively with inks of different colors; means mounting the ink ribbon to undergo movement with the print head and for movement obliquely across the print hammers such that respective ones of the ink ribbon color strips confront respective ones of the print hammers to enable the print hammers to print successively the same dot matrix character in superimposed relation using respective ones of the ink ribbon color strips to thereby effect multicolor printing; actuating means for selectively actuating the print hammers to press the corresponding ink ribbon color strips against the drum ridges in synchronism with the rotation of the drum to effect multicolor printing of dot matrix characters on a recording medium positioned between the drum and print head while the print head moves in one stroke; and means for compensating for variations in the speed of rotation of the drum to avoid non-registry of the printed superimposed dot matrix characters, the means for compensating comprising means positioning adjacent print hammers a distance apart equal to $P_h \times (N/k)$, or a multiple thereof, where $P_h$ represents the horizontal pitch of the dot matrix characters, N represents the number of drum ridges, and 1/k represents the speed reduction ratio.

12. A multicolor cross-hammer printer according to claim 11; wherein k is a divisor of N.

13. A multicolor cross-hammer printer according to claim 11; wherein all the print hammers are spaced equal distances apart.

14. A multicolor cross-hammer printer according to claim 11; wherein the actuating means comprises means for electromagnetically actuating the print hammers.

15. A multicolor cross-hammer printer according to claim 11; wherein the ink ribbon has four color strips impregnated respectively with black and three other color inks.

16. A multicolor cross-hammer printer according to claim 15; wherein the three other color inks comprise yellow, magenta, and cyan.

17. A multicolor cross-hammer printer according to claim 15; wherein k is a divisor of N.

18. A multicolor cross-hammer printer according to claim 15; wherein all the print hammers are spaced equal distances apart.

* * * * *